United States Patent [19]

Sato

[11] 4,183,314

[45] Jan. 15, 1980

[54] FEED CONTROL DEVICE FOR USE IN A SEWING MACHINE

[75] Inventor: Shuichi Sato, Utsunomiya, Japan

[73] Assignee: The Singer Company, New York, N.Y.

[21] Appl. No.: 22,905

[22] Filed: Mar. 22, 1979

[51] Int. Cl.[2] ..... D05B 27/22

[52] U.S. Cl. ..... 112/316; 112/317

[58] Field of Search ..... 112/316, 317, 314, 315, 112/323

[56] References Cited

U.S. PATENT DOCUMENTS

| | | | |
|---|---|---|---|
| 3,527,183 | 9/1970 | Szostak et al. | 112/323 |
| 3,834,334 | 9/1974 | Adams et al. | 112/316 |

*Primary Examiner*—H. Hampton Hunter

*Attorney, Agent, or Firm*—Robert E. Smith; Edward L. Bell; William V. Ebs

[57] ABSTRACT

A feed regulator means having both manual stitch length control and pattern cam control of the work feeding mechanism of a sewing machine. A feed regulator crank secured to a feed regulator shaft is the driven link of a four bar linkage system. A manually operable camming device is operably engaged with the four bar linkage for stitch length selection and for simultaneously establishing the proportionate amount of motion transmitted from a pattern cam, which is also operably engaged with the four bar linkage, to said feed regulator shaft. A proportional link is in operable engagement with said four bar linkage such that the stitch length selection of the camming device may be altered without effecting angular movement of said feed regulator crank when a portion of the pattern cam is being tracked which dictates a zero stitch length. The operator control device for stitch length selection, when depressed, will immediately reverse the direction of feed and will maintain a stitch length equal to the stitch length setting of the camming device. The reversal of feed is independent of and overrides the operation of said pattern cam.

3 Claims, 15 Drawing Figures

FEED CONTROL DEVICE FOR USE IN A SEWING MACHINE

BACKGROUND OF THE INVENTION

This invention relates to a feed regulator means for the work feeding mechanism of a sewing machine, in particular, of the drop feed type wherein the work engaging feed dog is elevated into work engagement during the feed advance stroke, and dropped out of work engagement during the return stroke. U.S. Pat. No. 3,527,183, issued Sept. 8, 1970, discloses a drop feed mechanism of this type. A significant problem in connection with this type of feed mechanism is the difficulty of providing manual control of the amplitude of stitch length of a pattern that is being sewn under pattern cam control and with the same mechanism, control the stitch length and with the pattern cam disengaged. Ideally, there should be a quick reverse capability that will operate independently of and override the operation of the pattern cam. It is considered desirable to provide a single integrated control that will easily and accurately perform these functions. U.S. Pat. No. 3,834,334, issued Sept. 10, 1974, discloses such a unitary control. It includes a feed regulator shaft rotatably mounted in the frame of the sewing machine, operably connected to a feed dog and adapted to influence movement imparted thereto, and a feed regulator lever arm secured to the regulator shaft. A floating link member is carried at one end thereof by an element associated with the pattern cam feed linkage system and is provided at its other end with a pin positionable along said feed regulator lever arm and engagable therewith. Manually operable means are provided for guiding said pin along the feed regulator lever arm for a stitch length selection and for simultaneously establishing the proportionate amount of motion transmitted from the pattern cam to the regulator shaft. Additionally, a manually actuated quick reverse feature is disclosed which overrides the manual or pattern cam controlled feed modes.

The above citations comprise what the applicant believes to be the closest prior art of which he is aware that is relevent to the examination of this application.

SUMMARY OF THE INVENTION

It is therefore an object of the present invention to provide a feed regulating means whereby a single manually operable control is utilized to effect stitch length adjustment both where pattern cam feed control is not engaged, and where such pattern cam feed control is engaged. The manually operable control will, in proportion to its setting, effect stitch length control over the motion imparted to the feed dog as provided by the pattern cam.

It is another object of this invention to include in the aforementioned manually operable control the capability that, when depressed by the operator, it will effect a reverse feed in correspondence to the stitch length setting for forward feed.

It is yet another object of the present invention to provide the aforementioned feed regulating means by use of a simple but unique system of linkage that may be easily manufactured, assembled and maintained.

Other objects and advantages of the invention will become apparent through reference to the accompanying drawings and descriptive matter which illustrates a preferred embodiment of the invention.

According to the present invention, there is provided a feed regulator means for the work feeding mechanism of a sewing machine, the machine having stitch forming instrumentalities including a work feeding mechanism actuated cyclically in timed relation with the stitch forming instrumentalities, a feed regulator shaft, a feed regulator means operatively associated with the feed regulator shaft for selectively varying the direction and magnitude of work advance movement of the work feeding mechanism, an operator actuatable stitch length control including a camming device that may be set to a selected position for effecting control of the feed regulator means, one or more pattern cams and a cam follower individually selectively engageable with the pattern cams, a linkage system operatively connecting the cam follower to the feed regulator means, wherein the feed regulator means comprises:

a. a four bar linkage operatively connected to the feed regulator shaft for imparting selective angular motion thereto, b. a tracking element associated with the four bar linkage and in cooperative engagement with the camming device for effecting manual control of the four bar linkage and thereby limiting the selective angular motion of the feed regulator shaft, c. a proportional link means directly actuated by the linkage system and in cooperative engagement with the four bar linkage for effecting pattern cam control of the four bar linkage and thereby varying the selective angular motion of the feed regulator shaft in proportional relation to the selected position of the camming device for varying the direction and magnitude of work advance movement of the work feeding mechanism, d. a reverse feed means actuated by the stitch length control in cooperative engagement with the four bar linkage for effecting manual reversal of the work advance movement of the work feeding mechanism in relation to the selected position of the camming device and independent of pattern cam control.

BRIEF DESCRIPTION OF THE DRAWINGS

In order that the invention may be more fully understood, it will now be described, by way of example, with reference to the accompanying drawings in which.

PREFERRED EMBODIMENT OF THE INVENTION

Figure 3:
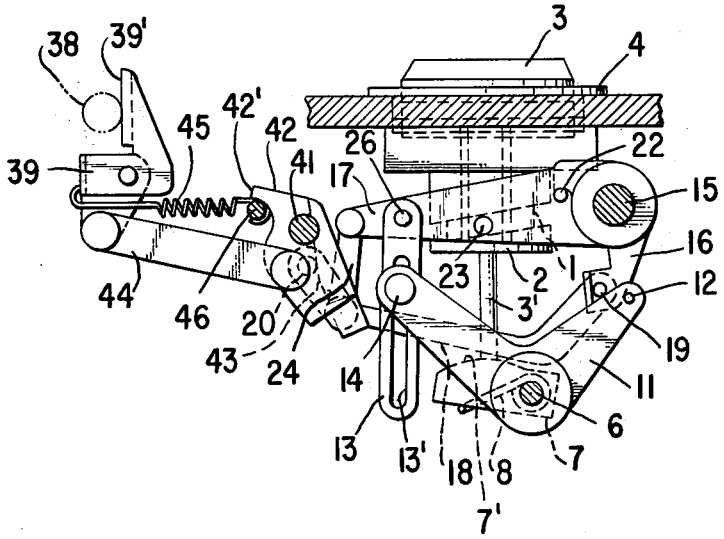
FIG. 3 is a side elevation taken along line 33 of FIG. 2.

Referring to FIGS. 1, 2, 3, and 4, there is shown a cylindrical feed control camming device 2, having a cam track 1 on its circumferance, rotatably supported in a bed of a sewing machine. Said camming device 2 having a square perforation 2' on its axis formed for slidingly receiving a square actuating shaft 3'. A feed selection knob 3 is rigidly fixed to one end of the square actuating shaft 3' which is dimensioned to cooperate with and impart turning movement to the camming device 2 on turning movement of the knob 3. A graduated plate 4 having feed graduations 4' is interposed between the knob 3 and the outer surface of the sewing machine for indicating the stitch length setting of the camming device 2. A lever support shaft 6 is rotatably supported by a base bracket 5 which is preferably fixed to the bed of the sewing machine. A back stitch lever 7 having a cam surface 7' is rigidly attached to the lever support shaft 6 and freely pivots therewith such that the cam surface 7' engages the end of the square actuator shaft 3' opposite the knob 3. A lever return spring 8 loosely fitted around the lever support shaft 6 is fastened at one end to the base bracket 5 and the other end is formed into a hook which engages the back stitch lever 7 such that the torsional force of the spring 8 causes the cam surface 7' of the lever 7 to push against the end of the square actuating shaft 3' and thereby urging it to its extreme upward position where a ring 10, which is rigidly fixed to the square actuating shaft 3', engages the lower surface of a limiter plate 9 which is rigidly fixed to the base bracket 5. By this arrangement, the knob 3 is urged to its most upward position by the spring 8 and held captive by the limiter plate 9 to prevent inadvertent removal. A reverse feed crank 11 is rigidly attached to the lever support shaft 6 and freely pivots therewith. The reverse feed crank 11 is Lshaped having two arms formed normal to each other and to the lever support shaft 6. One arm has a reverse feed pin 12 attached to its extremity projecting parallel to the lever support shaft 6 in a direction toward a feed regulator crank 16 which is subsequently described. The other arm has attached thereto a stud 14 which is pivotally and slidably coupled to a motion limit slot 13' which is formed totally enclosed and positioned at one end of a motion limit link 13. The other end of the motion limit link 13 is pivotally coupled to a motion limit pin 26, as shown in FIG. 3, which is rigidly attached to a first control arm 17, for a purpose hereinafter described.

Figure 4:
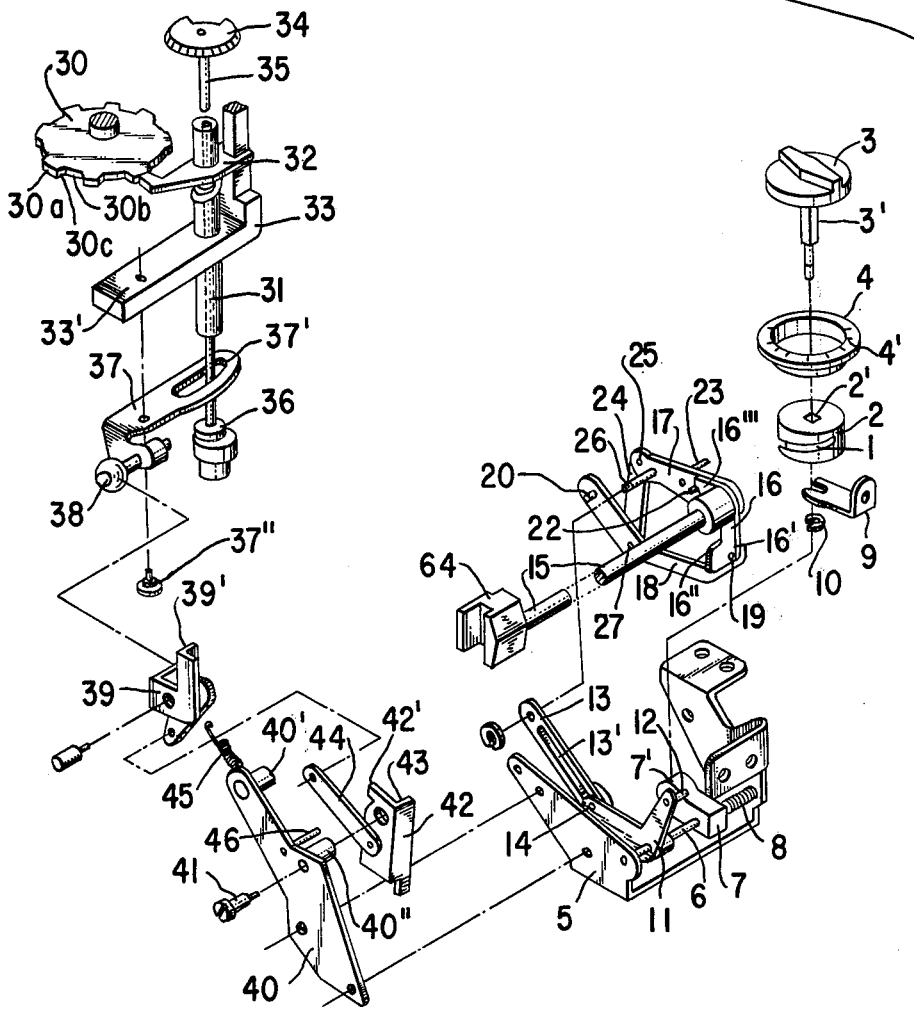
FIG. 4 is an exploded perspective illustrating the major portion of the mechanism of FIG. 1.

A feed regulator shaft 15 is pivotally supported in the frame of the machine, preferably in the bed thereof, and carries a feed regulator block 64 adjacent one end thereof. The feed regulator crank 16 is rigidly fixed to the other end of the feed regulator shaft for imparting pivotal motion to the shaft. The first control arm 17 is pivotally supported, adjacent to the feed regulator crank, on a portion of the feed regulator shaft 15 that projects through the feed regulator crank, and pivots independently thereof. One arm 16' of the feed regulator crank 16 contains an orthogonally formed crank tab 16'' which comes into operational engagement with the reverse feed pin 12 upon rotation of the lever support shaft 6. The arm 16' is pivotally coupled to one end of a second control arm 18 by means of a pin 19, to the other end is secured a second pin 20 projecting in the same direction as and parallel to the feed regulator shaft 15. The other arm 16''' of the feed regulator crank 16 is pivotally biased by a torsion spring 21 loosely fitted around the feed regulator shaft 15 and is urged into operational engagement with a first pin 22 which is rigidly fixed to the first control arm 17. A tracking element 23 is rigidly attached to the first control arm 17 and is parallel to the feed regulator shaft 15, projecting in a direction toward the camming device 2, and is in operational engagement with the cam track 1 formed on the periphery of camming device 2. Thus, as the knob 3 is rotated, the camming device will cause the first control arm 17 to pivot about the feed regulator shaft 15. As shown in FIG. 4, the end of first control arm 17 that projects away from the feed regulator shaft 15 is pivotally coupled to one end of an idler link 24 by means of a pin 25, the other end of the idler link being similarly coupled to the second control arm 18 by means of a pin 27. The distance from the axis of pin 19 to the axis of pin 27 is substantially equal to the distance from the axis of feed regulator shaft 15 to the axis of pin 25. Similarly, the distance from the axis of pin 25 to the axis of pin 27 is substantially equal to the distance from the axis of pin 19 to the axis of feed regulator shaft 15, thus forming a parallelogram shaped four bar linkage.

Figure 5:
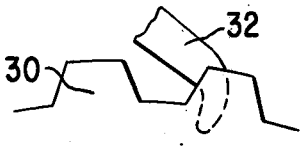
FIGS. 5, 6, 7 and 8 are diagrams illustrating the relationship of the pattern cam to the cam follower.
Figure 6:
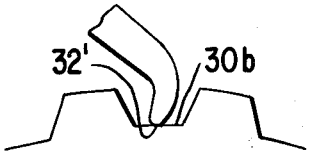
Figure 7:
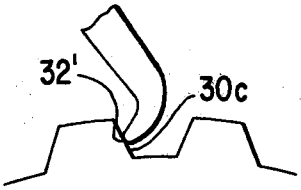
Figure 8:
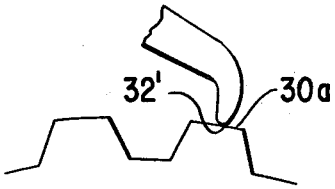

At least one pattern cam 30 is mounted rotatably in the frame of the machine. Such cams provide for cam control in the work feeding mechanism by conventional and well known use of a cam follower 32, a follower guide 33, a follower shaft 31, transmitting the motion through an eccentric balance mechanism in the form of an adjustment plate 37 which operably engages an eccentric 36, and a shaft 35 rigidly fixed to the eccentric 36 and rotatably journaled through the follower shaft 31. A manually actuatable balance dial 34 is fixed to the shaft 35. Turning of this dial will effect a corresponding angular movement of the eccentric 36 which will influence the angular position of the adjustment plate 37 about a fulcrum screw 37'' thereof which is threaded into the follower guide 33 thus balancing forward and reverse feed when a pattern cam is operationally engaged. This will compensate, for example, for differences encountered in frictional resistances exhibited by different materials. Certain materials offer greater resistance to feed movement in one direction than in the opposite direction. Although the incremental distance traversed by the feed dog in forward feed may be equal to that in reverse feed, the fabric may not move equally in both directions. This eccentric balance mechanism enables the operator to compensate for any such difference found under specific operating conditions. FIG. 5 illustrates the position of the cam follower 32 when the pattern cam is not engaged for controlling the feed mechanism while FIGS. 6, 7 and 8 illustrate the relationship of the cam follower to the pattern cam when the cam is engaged. A tip 32' of the cam 32 is urged into operational contact with the pattern cam 30 by virtue of the force exerted by a spring 45. A ball 38 supported by the adjustment plate 37 is brought into contact with an abutment surface 39' of a follower lever 39. A support bracket 40 having mounting bosses 40' and 40'' is mounted rigidly to the base bracket 5. The follower lever 39 is rotatably supported on the boss 40'. A proportional link 42 is rotationally supported on the boss 40'' by means of a pivot shaft 41, the proportional link 42 having an arcuate surface 43 on its inner side is pivotally coupled to one end of a link 44, the other end of which is pivotally coupled to the follower lever 39. One end of the spring 45 is hooked to the follower lever 39 and the other end is hooked to a stop member 46 rigidly fixed to the bracket support 40 such that the abutment surface 39' formed on the follower lever 39 is urged toward the direction of the ball 38, and an end portion 42' of the proportional link 42 is urged into contact with the stop member 46. The arcuate surface 43 of the proportional link 42 is described as the locus of points scribed by the inner surface of the second pin 20 when the second control arm 18 is pivoted about the pin 19. In other words, the radius of the arcuate surface 43 equals the distance from the axis of pin 19 to the axis of second pin 20 less the radius of the second pin 20. The torsion spring 21 applies a torsional bias to the feed regulator shaft 15 such that the second pin 20 is held in operational engagement with the arcuate surface 43. When the feed selection knob 3 is set to a position of zero feed, the center of the second pin 20 will be substantially coincident with the center of the pivot shaft 41. This occurs when the tracking element 23 of the first control arm 17 is located at the highest position of the cam groove 1. It is preferable that the distance between the axis of the pivot shaft 41 and the axis of the feed regulator shaft 15 be substantially equal to the distance between the axis of the second pin 20 and the axis of the pin 19.

Figure 1:
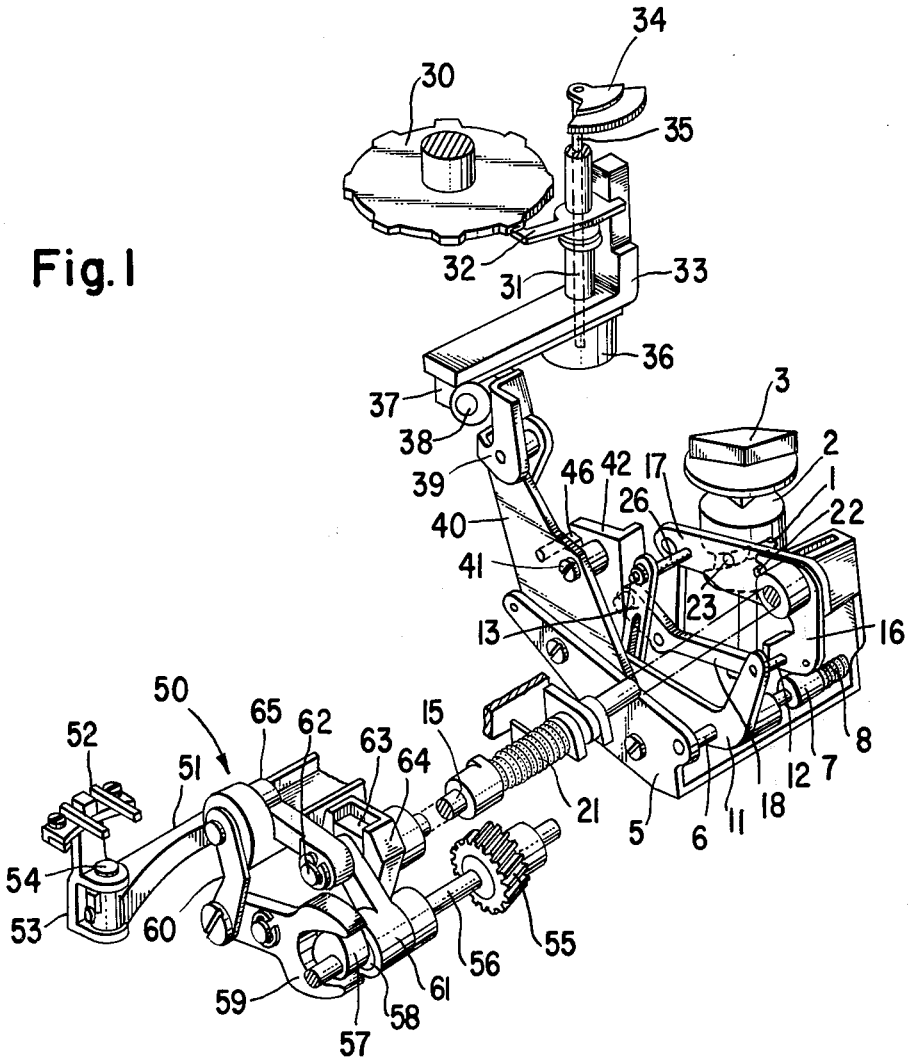
FIG. 1 is a perspective view of a work feeding mechanism which includes a preferred embodiment of the invention.
Figure 2:
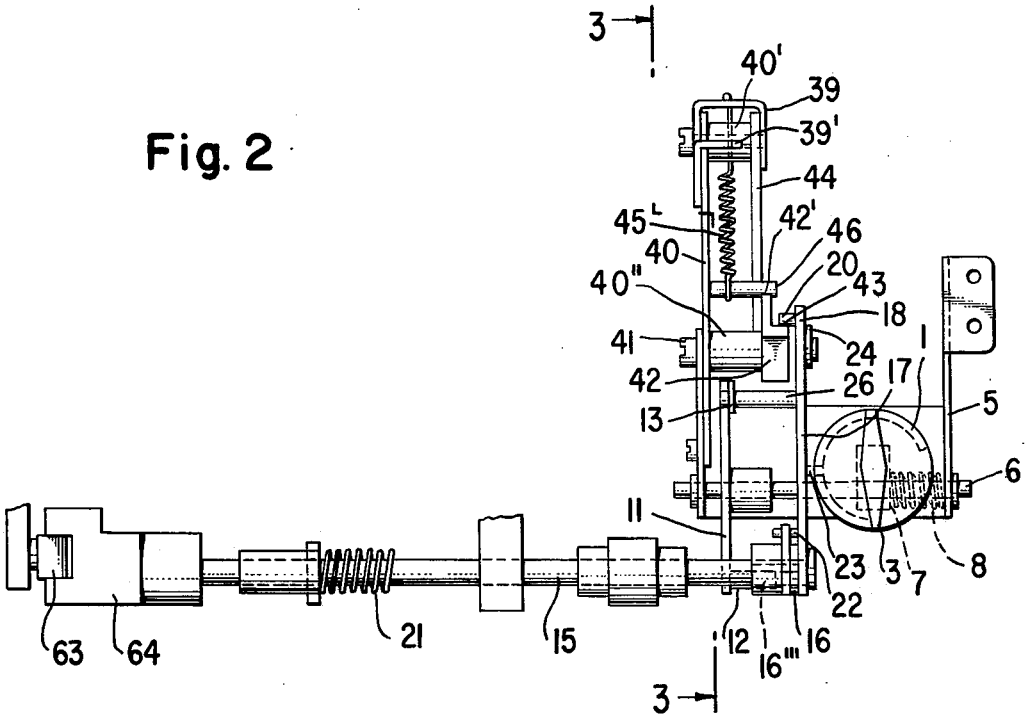
FIG. 2 is a plan view showing a major portion of the mechanism in FIG. 1.

As shown in FIG. 1, the invention influences a work piece feeding mechanism which includes a feed bar 51 mounted pivotally in the bed portion of the machine (not shown) such that it may be oscillated in mutually perpendicular directions so as to impart to a feed dog 52 substantially vertical and horizontal motion. The feed dog is carried by a bracket 53 which is secured to a pivot pin 54 journalled in the feed bar. A feed shaft 56 is journalled in the bed of the machine and is provided with a gear 55 adapted to be driven in synchronism with the sewing instrumentalities of the machine. Affixed to the feed shaft is a lift cam 57 preferably of the triangular or constant breadth type and a feed advance eccentric 58. The lift cam imparts vertical motion to the feed bar through a bifurcated lever 59, a link 60 and a pin and block assembly indicated generally by reference 50. Transverse feed motion is imparted to the feed bar by means of the feed advance eccentric 58, a pitman 61, a slide block 63, the feed regulator block 64 and the link 65. U.S. Pat. No. 3,527,183 may be referred to for a more detailed discussion of the interrelationship of these elements.

Figure 9:
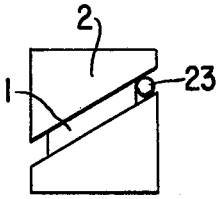
FIGS. 9 and 11 are diagrams illustrating the relationship of the camming device to the tracking element.
Figure 10:
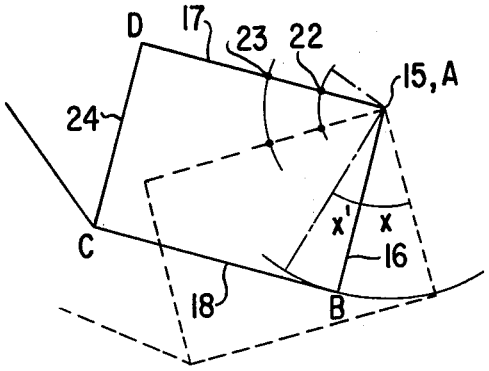
FIG. 10 is a diagram illustrating the operation of the feed regulator crank and first control arm when the pattern cam is disengaged.

As seen in FIG. 9, when the feed selection knob 3 is rotated to a position indicated at zero on the graduated plate 4, the tracking element 23 of the first control arm 17 is moved to the highest position of the cam groove 1 of the camming device 2. As this occurs, the first pin 22 urges the arm 16''' of the feed regulator crank 16 upwardly thereby rotating the feed regulator shaft 15 overcoming the torsional force produced by the torsion spring 21, and the feed regulator block 64 is set such that the work feeding mechanism imparts no forward or reverse movement to the work. This is indicated schematically by the solid lines in FIG. 10. By depressing the feed selection knob 3, the square actuating shaft 3' pushes against the cam surface 7' of the back stitch lever 7 causing the lever 7, the lever support shaft 6, and the reverse feed crank 11 to rotate against the torsional force of the lever return spring 8. The reverse feed pin 12 is then brought into operational engagement with the crank tab 16'' of the feed regulator crank 16 and simultaneously, stud 14, which is slidably engaged with the slot 13', engages the lower portion of that slot thus preventing reversal of feed.

Figure 11:
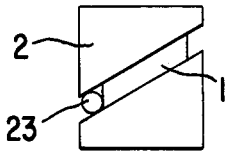

When the feed selection knob 3 is turned to a desired feed stitch length setting other than zero as indicated by the graduated plate 4, the square actuating shaft 3' which is fixed to the knob 3, causes the camming device 2 to rotate, and as indicated in FIG. 11, the tracking element 23 of the first control arm 17 which is engaged with the cam groove 1, is moved downwardly. Because the arm 16''' of the feed regulator crank 16 is maintained in contact with the first pin 22 due to the torsional force of the torsion spring 21, the feed regulator shaft 15 is caused to rotate in proportion to the downward movement of the tracking element 23. The angle of inclination (x) of the feed regulator shaft 15 is imparted to the feed regulator block 64 whereby the stitch length is set. Backward stitching at a stitch length equal to that set on the graduated plate 4 is effected by depressing the feed selection knob 3. As described above, the square actuating shaft 3' then causes the back stitch lever 7, lever support shaft 6 and reverse feed crank 11 to rotate against the torsional force of the lever return spring 8. The reverse feed pin 12 comes into contact with the crank tab 16'' as before, however, because the tracking element 23 is now in a lower position with respect to the cam groove 1. The motion limit pin 26 and the motion limit link 13 are also in a lower position so that the stud 14 has not yet engaged the bottom of the limit link slot 13'. The back stitch lever 7, lever support shaft 6, and reverse feed crank 11 continue to pivot until the stud 14 engages the bottom of the slot 13'. This results in the feed regulator block 64 being positioned at an angle of inclination (x') which is equal in magnitude and of an opposite direction to the angle of inclination (x) of the setting for forward feed. This effects reverse feeding with a stitch length exactly equal to the stitch length that was set as indicated by the graduated plate 4 for forward feeding.

Figure 12:
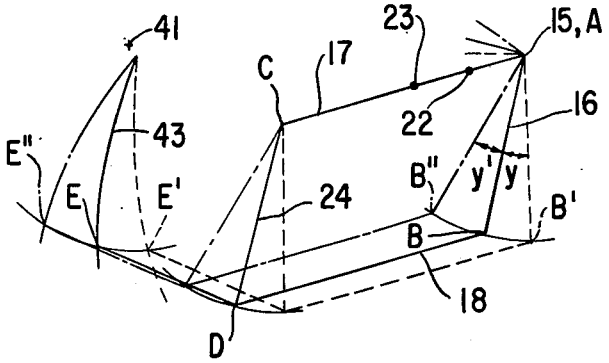
FIG. 12 is a diagram illustrating the relationship of the follower lever to the four bar linkage.
Figure 13:
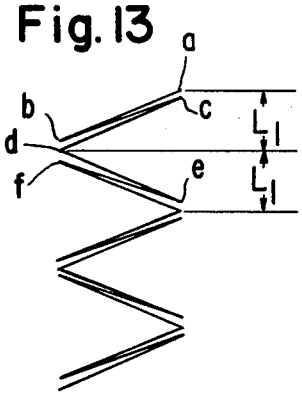
FIGS. 13 and 14 are diagrams showing examples of stitch patterns.
Figure 14:
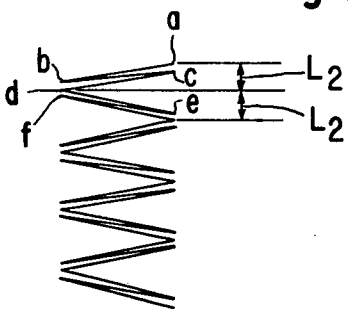
Figure 15:
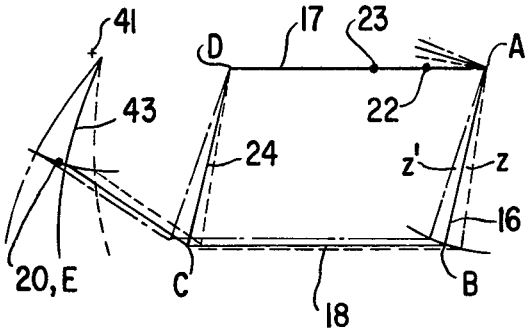
FIG. 15 is a diagram illustrating the relationship of the follower lever to the four bar linkage as the feed selection knob is manually rotated from a position of longer stitch length to a position of shorter stitch length.

Referring now to FIGS. 6, 7, 8 and 12, when the feed selection knob 3 is rotated to locate the tracking element 23 in the lowest position in the cam groove 1 of the camming device 2, giving maximum stitch length, and when the tip 32' of the cam follower 32 is located at a position nearly at the center of an inclined surface **30*c*, which is connecting a high portion 30*a* of the pattern cam 30 to a low portion 30*b*, as shown in FIG. 7, the feed regulator crank 16, as schmatically shown as line AB in FIG. 12, rotates the feed regulator shaft 15 such that the feed regulator block 64 is set at zero feed. This is the same position that the feed regulator block 64 would assume when the feed selection knob 3 is set on zero, as indicated by the solid lines in FIG. 12. This results in the arm 16''' disengaging from the first pin 22. As the pattern cam 30 turns, and the tip 32' moves to a low portion 30*b* of the pattern cam 30, see FIG. 6, the proportional link 42 turns from the position E to the position E', rotating about the pivot shaft 41 and the second pin 20 of the second control arm 18 maintaining contact with the arcuate surface 43 allows the feed regulator crank 16, as indicated schmatically in FIG. 12 by solid line AB, to move to a new position indicated by dotted line AB', with the axis of the feed regulator shaft 15 being the pivotal point and first control arm 17 being stationary. As seen, the feed regulator block 64 is inclined by an angle (y) to give a maximum stitch length in forward feed. As the pattern cam 30 continues to turn, the tip 32' moves to a high portion 30*a* of the pattern cam, as in FIG. 8. The proportional link 42 pivots about the axis of the pivot shaft 41 such that the arcuate surface 43 moves from position E' to position E", as illustrated in FIG. 12. The second pin 20 of the second control arm 18 moving with the arcuate surface 43 allows the feed regulator crank 16 to move from position AB' to position AB". The feed regulator block 64 is now inclined by an angle (y') which is equal in magnitude and of an opposite direction to the angle (y) thereby giving a maximum stitch length in reverse feed. The angle of inclination (y) of the forward feed equals the angle of inclination (y') for reverse feed thereby providing a theoretical stitch length in reverse feed substantially equal to the stitch length in forward feed. Due to different surface structures of various materials, however, some materials do not always feed the same in both directions. This may be compensated for by turning the balance dial 34 by hand, imparting angular motion to the eccentric 36 and thereby slightly skewing the ball 38 to one side. This causes the angle of inclination (y) to be slightly different than the angle of inclination (y'), the larger one depending on which way the balance dial 34 was turned thereby giving a shorter theoretical stitch length in one direction than in the other. FIG. 13 illustrates a typical stitch pattern obtained by the cooperation of the pattern cam 30 and a zigzag cam which is not shown. The tip 32' is located in a low portion 30*b* of pattern cam 30 while the stitch needle moves along line ab, the feed regulator crank 16 inclined as indicated by line AB', of FIG. 12, to produce a forward feed of $L_1$. As the pattern cam 30 continues to turn and the tip 32' moves to an upper portion 30*a* of the pattern cam 30 while the stitch needle moves along line bc, the feed regulator crank 16 is then inclined as indicated by phantom line AB" thereby producing a backward feed of $L_1$. As the pattern cam 30 continues to turn, the cam follower 32 moves to a lower portion 30*b* of the pattern cam and the stitch needle moves along line cd. By repeating these operations, the stitch pattern shown in FIG. 13 will be created. By manually turning the feed selection knob 3, such that the tracking element 23 moves upwardly, in the cam groove 1, the feed regulator block 64 will be positioned at an angle that reduces the stitch length from $L_1$ to $L_2$ thereby achieving a stitch pattern as illustrated in FIG. 14. When turning the feed selection knob 3 in order to obtain this stitch pattern, the first control arm 17 is raised thereby causing the second control arm 18 to also raise by virtue of the idler link 24, and the second pin 20 rides along the arcuate surface 43 of the proportional link 42 and is moved upwardly toward the pivot shaft 41. The pivotal oscillation of the arcuate surface 43 about the axis of the pivot shaft 41 represents the rise and fall of the cam follower 32 on the pattern cam 30. The second pin 20 following this arcuate surface 43 transmits the oscillating motion through the four bar linkage to the feed regulator shaft 15 in proportion to the position of the second pin 20 on the arcuate surface 43. Therefore, as shown in FIG. 15, the first control arm 17, represented by line AD, remains stationary and the second control arm 18, represented by line BC, moves reciprocally with points A and D serving as pivot points. Thus the oscillation of the second pin 20 resulting from the rotation of the pattern cam 30 imparts a proportional motion to the feed regulator crank 16 represented by line AB. The oscillating angles (z) and (z') of the feed regulator block 64, as shown in FIG. 15, are reduced to obtain a stitch pattern, as shown in FIG. 14, having a stitch length $L_2$. When the feed selection knob 3 is turned to a setting of zero stitch length, the tracking element 23 will be in its upper most position in the cam groove 1. The second pin 20 of the second control arm 18 is then positioned such that its axis is substantially in line with the axis of the pivot shaft 41. With the second pin 20 in this position, any oscillation of the proportionate link 42 caused by the pattern cam 30 is not transmitted to the second control arm 18** so that a stitch length of zero is effected.

I claim:

1. In a sewing machine having stitch forming instrumentalities including a work feeding mechanism actuated cyclically in timed relation with said stitch forming instrumentalities, a feed regulator shaft, a feed regulator means operatively associated with said feed regulator shaft for selectively varying the direction and magnitude of work advance movement of said work feeding mechanism, an operator actuatable stitch length control including a camming device that may be set to a selected position for effecting control of said feed regulator means, at least one pattern cam and a cam follower individually selectively engageable with said at lease one pattern cam, a pattern cam linkage system operatively connecting said cam follower to said feed regulator means, wherein said feed regulator means comprises:

a. a four bar linkage operatively connected to said feed regulator shaft for imparting selective, angular motion thereto;

b. a tracking element associated with said four bar linkage and in cooperative engagement with said camming device for effecting manual control of said four bar linkage and thereby limiting said selective angular motion of said feed regulator shaft;

c. a proportional link directly actuated by said pattern cam linkage system and in cooperative engagement with said four bar linkage for effecting pattern cam control of said four bar linkage and thereby varying said selective angular motion of said feed regulator shaft in proportional relation to said selected position of said camming device for varying the direction and magnitude of work advance movement of said work feeding mechanism;

d. a reverse feed means actuated by said stitch length control in cooperative engagement with said four bar linkage for effecting manual reversal of said work advance movement of said work feeding mechanism in relation to said selected position of said camming device and independent of said pattern cam control.

2. In a work feeding mechanism for a sewing machine as recited in claim 1 wherein:

a. said four bar linkage comprises a feed regulator crank rigidly attached to said feed regulator shaft for imparting controlled angular movement thereto, a first control arm pivotally supported at one end of said feed regulator shaft and the other end of said first control arm pivotally coupled with one end of an idler link, the other end of said idler link being pivotally coupled with a second control arm, the other end of said second control arm pivotally coupled with said feed regulator crank for imparting a controlled rocking movement thereto, said feed regulator crank having an end portion formed substantially normal to said feed regulator shaft and urged into operational contact with a first pin rigidly attached to said first control arm by a spring rotationally biasing said feed regulator shaft in one direction;

b. said tracking element being rigidly fixed to said first control arm and in operative engagement with said camming device for imparting controlled pivotal motion to said first control arm about the axis of said feed regulator shaft, and thereby effecting said manual control of said four bar linkage;

c. said proportional link comprises an arcuate surface maintained in sliding engagement with a second pin rigidly attached to said second control arm, said proportional link pivotally supported on a pivot shaft whose axis is maintained at a fixed distance from and substantially parallel to the axis of said feed regulator shaft, said fixed distance being substantially equal to the distance from the axis of said second pin to the axis of the point where said second control arm is pivotally coupled with said feed regulator crank, said proportional link being pivotally coupled to said pattern cam linkage system for imparting controlled rocking motion to said proportional link about said pivot shaft and a corresponding motion to said second pin, an end portion engageable with a stop member for limiting the angular motion of said proportional link such that when said cam follower is disengaged from said pattern cam said end portion is urged in contact with said stop member by said pattern cam linkage system, and thereby effecting pattern cam control of said four bar linkage in proportional relation to said selected position of said camming device.

3. In a work feeding mechanism for a sewing machine as recited in claim 2 wherein said reverse feed means comprises:

a lever support shaft substantially parallel to said feed regulator shaft and pivotally supported in a base bracket, said base bracket being rigidly attached to the bed of said sewing machine, a reverse feed crank rigidly attached to said lever support shaft and pivotal therewith, said reverse feed crank having two arms formed normal to each other and to said lever support shaft, the first of said arms having a reverse feed pin rigidly attached to its extremity, the axis of said reverse feed pin being substantially parallel to the axis of said lever support shaft for operational engagement with a crank tab, said crank tab being orthogonally formed from the end extremity of said feed regulator crank, the second of said arms at its extremity being pivotally and slidably coupled with a motion limit slot of a motion limit link, said slot being totally enclosed and of a length less than the length of said motion limit link and positioned at one end thereof, the other end thereof being pivotally coupled to a motion limit pin which is rigidly attached to said first control arm for limiting the motion of said reverse feed crank in relation to said selected position of said camming device, a back stitch lever rigidly attached to said lever support shaft and pivotal therewith, said back stitch lever having a cam surface urged into contact with the end of an actuating shaft by the action of a lever return spring, said actuating shaft being operatively coupled with said operator actuatable stitch length control for transmitting a linear pushing motion to said cam surface thereby pivoting said back stitch lever and said reverse feed crank and imparting controlled angular movement to said feed regulator crank for effecting manual reversal of said work advance movement of said work feeding mechanism in relation to said selected position of said camming device.

* * * * *